US010619435B2

(12) United States Patent
Greci et al.

(10) Patent No.: US 10,619,435 B2
(45) Date of Patent: Apr. 14, 2020

(54) SELF-REGULATING TURBINE FLOW

(71) Applicant: Halliburton Energy Services, Inc., Houston, TX (US)

(72) Inventors: Stephen Michael Greci, Little Elm, TX (US); Richard Decena Ornelaz, Frisco, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/337,352

(22) PCT Filed: Mar. 12, 2018

(86) PCT No.: PCT/US2018/021954

§ 371 (c)(1),
(2) Date: Mar. 27, 2019

(87) PCT Pub. No.: WO2019/177565

PCT Pub. Date: Sep. 19, 2019

(65) Prior Publication Data

US 2020/0040676 A1 Feb. 6, 2020

(51) Int. Cl.

| | |
|---|---|
| ***E21B 41/00*** | (2006.01) |
| ***E21B 43/12*** | (2006.01) |
| ***E21B 21/08*** | (2006.01) |
| ***E21B 47/12*** | (2012.01) |

(52) U.S. Cl.
CPC ..... *E21B 21/08* (2013.01); *E21B 41/0085* (2013.01); *E21B 43/12* (2013.01); *E21B 47/124* (2013.01)

(58) Field of Classification Search
CPC ..... E21B 41/0085; E21B 43/12; E21B 34/06
See application file for complete search history.

(56) References Cited

U.S. PATENT DOCUMENTS

| | | | | |
|---|---|---|---|---|
| 5,412,568 | A | 5/1995 | Schultz | |
| 6,182,764 | B1 | 2/2001 | Vaynshteyn | |
| 7,171,309 | B2 | 1/2007 | Goodman | |
| 7,190,084 | B2 * | 3/2007 | Hall | E21B 41/0085 290/1 R |
| 7,673,680 | B2 | 3/2010 | Buyers et al. | |

(Continued)

FOREIGN PATENT DOCUMENTS

| | | |
|---|---|---|
| WO | 2006085869 A1 | 8/2006 |
| WO | 2018093378 | 5/2018 |
| WO | 2018125048 | 7/2018 |

OTHER PUBLICATIONS

International Search Report and Written Opinion dated Dec. 10, 2018; International PCT Application No. PCT/US2018/021954.

*Primary Examiner* — Shane Bomar
(74) *Attorney, Agent, or Firm* — McGuireWoods LLP

(57) ABSTRACT

A downhole assembly includes a base pipe, a power generator, and a flow control device positioned within a flow path for a fluid that extends between the exterior and the interior of the base pipe. The flow control device can control an amount of incoming flow that is directed to the power generator and an amount that is directed to the interior of the base pipe without passing through the power generator. A flow through the power generator can be maintained so that power is provided throughout operation of the flow control device.

20 Claims, 11 Drawing Sheets

(56) References Cited

U.S. PATENT DOCUMENTS

| | | | | |
|---|---|---|---|---|
| 7,983,113 | B2 | 7/2011 | Krueger et al. | |
| 8,033,328 | B2 | 10/2011 | Hall et al. | |
| 8,169,854 | B2 | 5/2012 | Godager | |
| 8,196,678 | B2 | 6/2012 | Jeffryes | |
| 8,319,657 | B2 | 11/2012 | Godager | |
| 8,678,035 | B2 | 3/2014 | Fripp et al. | |
| 9,638,010 | B2 * | 5/2017 | Kim | E21B 41/0085 |
| 2008/0047753 | A1 * | 2/2008 | Hall | E21B 41/0085 175/57 |
| 2009/0101341 | A1 | 4/2009 | Willauer | |
| 2009/0194289 | A1 | 8/2009 | Clem | |
| 2010/0181067 | A1 | 7/2010 | Chen et al. | |
| 2011/0198097 | A1 * | 8/2011 | Moen | E21B 34/08 166/373 |
| 2012/0067567 | A1 * | 3/2012 | Rytlewski | E21B 41/0085 166/250.01 |
| 2012/0091732 | A1 * | 4/2012 | Fallet | E21B 41/0085 290/40 R |
| 2013/0153242 | A1 * | 6/2013 | Flight | E21B 33/0355 166/363 |
| 2013/0220633 | A1 * | 8/2013 | Felten | E21B 43/08 166/373 |
| 2014/0034308 | A1 * | 2/2014 | Holderman | E21B 34/08 166/279 |
| 2016/0265315 | A1 | 9/2016 | Frosell et al. | |
| 2018/0106137 | A1 * | 4/2018 | Frosell | E21B 34/14 |
| 2018/0171752 | A1 * | 6/2018 | Cherny | E21B 34/06 |
| 2018/0283134 | A1 * | 10/2018 | Ornelaz | E21B 43/08 |
| 2019/0242213 | A1 * | 8/2019 | Hunter | E21B 34/063 |

* cited by examiner

SELF-REGULATING TURBINE FLOW

TECHNICAL FIELD

The present description relates in general to optimizing drilling operations, and more particularly to, for example, without limitation, remotely and mechanically actuated tools for use in subterranean well systems.

BACKGROUND OF THE DISCLOSURE

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as production tubing. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole fluid flow regulation and, more particularly, to downhole assemblies having flow control devices that use a pressure-balanced piston and associated actuator to regulate fluid flow production.

The embodiments described herein discuss downhole assemblies including flow control devices that are mechanically actuatable to regulate fluid flow along a flow path extending into an interior of a base pipe. The downhole assemblies operate to provide flow to a power generator to produce flow-induced electrical power, even when the flow control device is closed or partially closed. The downhole assemblies can further operate to adjust flow to the power generator to compensate for adjustments of flow that bypasses the power generator, thereby providing substantially consistent production of power.

Figure 1:
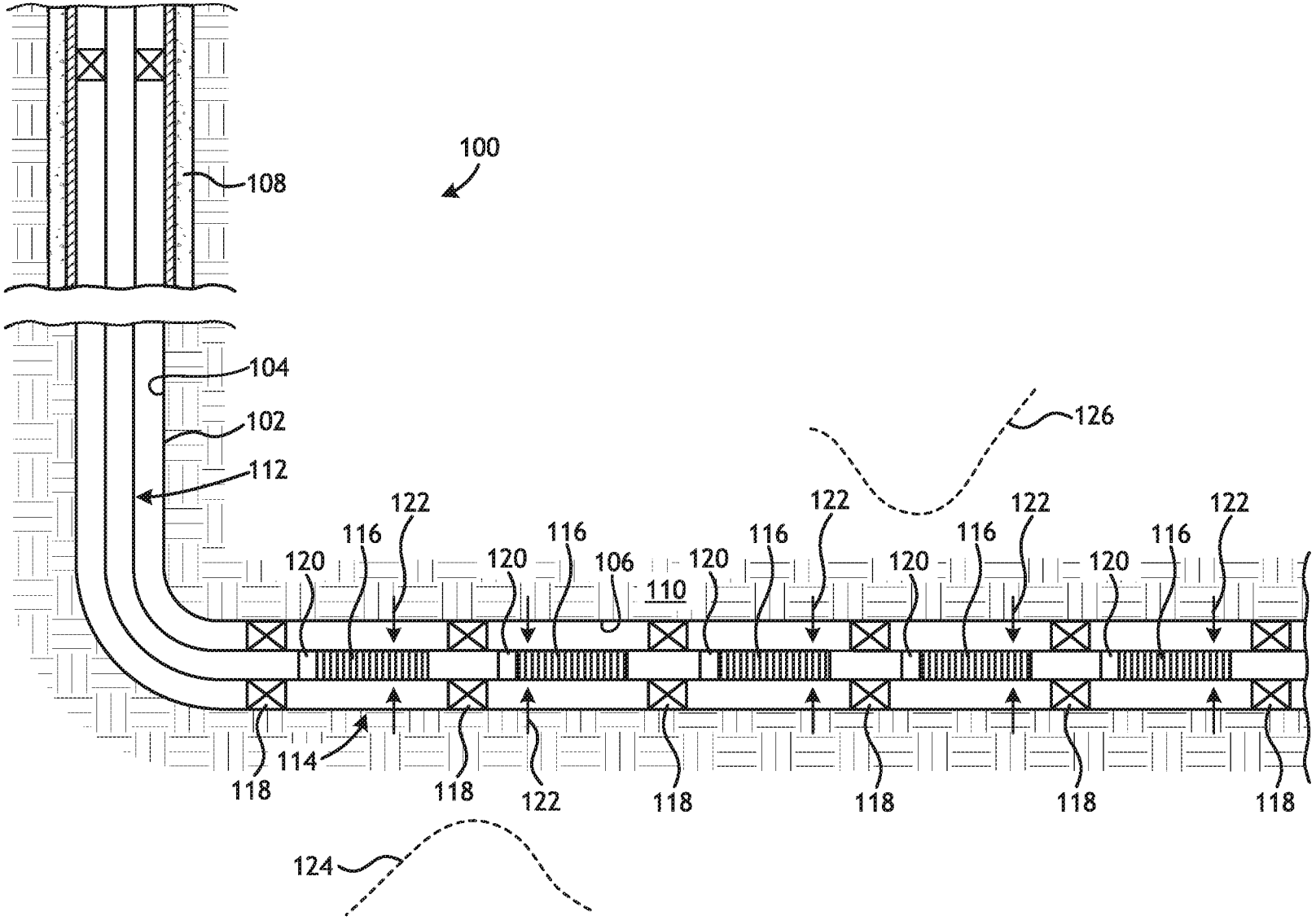
FIG. 1 illustrates a schematic drawing of a well system that may employ aspects of the present disclosure.

FIG. 1 illustrates a schematic diagram of an exemplary well system 100 that may employ one or more of the principles of the present disclosure, according to one or more embodiments. As depicted, the well system 100 includes a wellbore 102 that extends through various earth strata and has a substantially vertical section 104 that transitions into a substantially horizontal section 106. A portion of the vertical section 104 can have a string of casing 108 cemented therein, and the horizontal section 106 can extend through a hydrocarbon bearing subterranean formation 110. In some embodiments, the horizontal section 106 can be uncompleted and otherwise characterized as an "open hole" section of the wellbore 102. In other embodiments, however, the casing 108 can extend into the horizontal section 106, without departing from the scope of the disclosure.

A string of production tubing 112 can be positioned within the wellbore 102 and extend from a surface location (not shown), such as the Earth's surface. The production tubing 112 provides a conduit for fluids extracted from the formation 110 to travel to the surface location for production. A completion string 114 can be coupled to or otherwise form part of the lower end of the production tubing 112 and arranged within the horizontal section 106. The completion string 114 divides the wellbore 102 into various production intervals adjacent the subterranean formation 110. To accomplish this, as depicted, the completion string 114 can include a plurality of downhole assemblies 116 axially offset from each other along portions of the production tubing 112. Each downhole assembly 116 can be positioned between a pair of wellbore packers 118 that provides a fluid seal between the completion string 114 and the inner wall of the wellbore 102, and thereby defining discrete production intervals.

One or more of the downhole assemblies 116 can further include a flow control device 120 used to restrict or otherwise regulate the flow of fluids 122 into the completion string 114 and, therefore, into the production tubing 112. In operation, each downhole assembly 116 serves the primary function of filtering particulate matter out of the production fluid stream originating from the formation 110 such that particulates and other fines are not produced to the surface. Moreover, as described in more detail below, the flow control devices 120 can be actuatable and otherwise operable to regulate the flow of the fluids 122 into the completion string 114.

Regulating the flow of fluids 122 into the completion string 114 from each production interval can be advantageous in preventing water coning 124 or gas coning 126 in the subterranean formation 110. Other uses for flow regulation of the fluids 122 include, but are not limited to, balancing production from multiple production intervals, minimizing production of undesired fluids, maximizing production of desired fluids, etc. The flow control devices 120 described herein enable such benefits by providing a force-balanced flow controller that regulates the flow of the fluid 122 from the subterranean formation 110 to the interior of the completion string 114.

It should be noted that even though FIG. 1 depicts the downhole assemblies 116 as being arranged in an open hole portion of the wellbore 102, embodiments are contemplated herein where one or more of the downhole assemblies 116 is arranged within cased portions of the wellbore 102. Also, even though FIG. 1 depicts a single downhole assembly 116 arranged in each production interval, any number of downhole assemblies 116 can be deployed within a particular production interval without departing from the scope of the disclosure. In addition, even though FIG. 1 depicts multiple production intervals separated by the packers 118, any number of production intervals with a corresponding number of packers 118 can be used. In other embodiments, the packers 118 can be entirely omitted from the completion interval, without departing from the scope of the disclosure.

Furthermore, while FIG. 1 depicts the downhole assemblies 116 as being arranged in the horizontal section 106 of the wellbore 102, the downhole assemblies 116 are equally well suited for use in the vertical section 104 or portions of the wellbore 102 that are deviated, slanted, multilateral, or any combination thereof. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
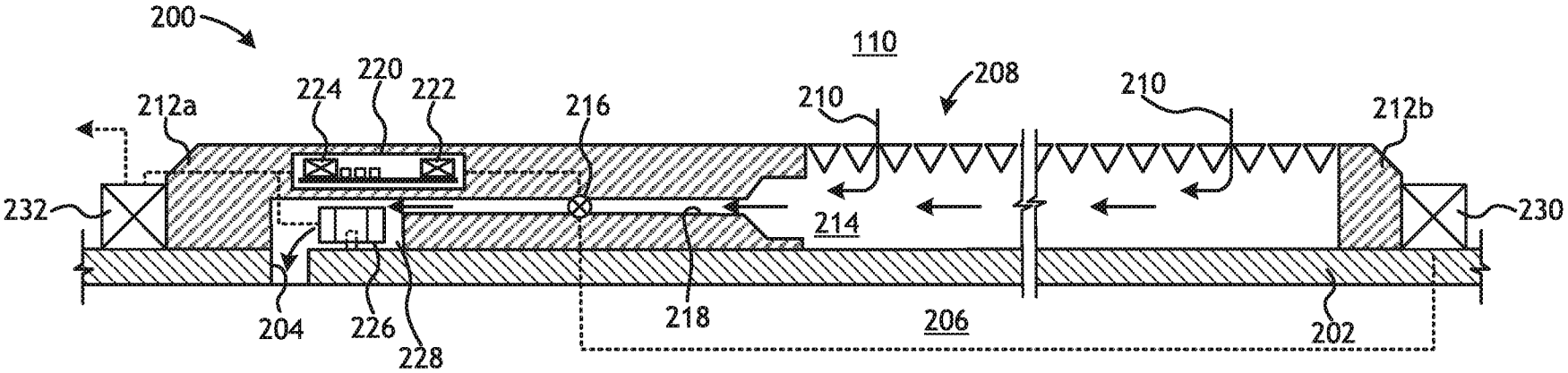
FIG. 2 illustrates a sectional schematic view of an exemplary downhole assembly.

FIG. 2 illustrates a cross-sectional schematic view of an exemplary downhole assembly 200, according to one or more embodiments. The downhole assembly 200 can be the same as or similar to any of the downhole assemblies 116 of FIG. 1 and, therefore, can be used in the well system 100 (FIG. 1). The downhole assembly 200 can include or otherwise be arranged about a base pipe 202 that defines one or more openings or power generator outlets 204 that facilitate fluid communication between an interior 206 of the base pipe 202 and the surrounding subterranean formation 110. The base pipe 202 forms part of the completion string 114 (FIG. 1) and can coupled to or form an integral extension of the production tubing 112 (FIG. 1).

As illustrated, the downhole assembly 200 can further include a sand screen 208 that extends about the exterior of the base pipe 202. The sand screen 208 and its various components serve as a filter medium designed to allow fluids 210 derived from the formation 110 to flow therethrough but prevent the influx of particulate matter of a predetermined size.

As illustrated, the sand screen 208 can generally extend between an upper end ring 212*a* arranged about the base pipe 202 at a first or uphole end and a lower end ring 212*b* arranged about the base pipe 202 at a second or downhole end. The upper end ring 212*a* and the lower end ring 212*b* provide a mechanical interface between the base pipe 202 and the opposing axial ends of the sand screen 208. In one or more embodiments, however, the lower end ring 212*b* can be omitted and the sand screen 208 can alternatively be coupled directly to the base pipe 202 at its downhole end. Each of the upper end ring 212*a* and the lower end ring 212*b* can be formed from a metal, such as 13 chrome, 304L stainless steel, 316L stainless steel, 420 stainless steel, 410 stainless steel, INCOLOY® 825, iron, brass, copper, bronze, tungsten, titanium, cobalt, nickel, combinations thereof, or the like. Moreover, each of the upper end ring 212*a* and the lower end ring 212*b* can be secured to the outer surface of base pipe 202 by being welded, brazed, threaded, mechanically fastened, combinations thereof, or the like.

The sand screen 208 can be fluid-porous, particulate restricting device made from of a plurality of layers of a wire mesh that are diffusion bonded or sintered together to form a fluid-porous wire mesh screen. In other embodiments, however, the sand screen 208 can have multiple layers of a weave mesh wire material having a uniform pore structure and a controlled pore size that is determined based upon the properties of the formation 110. For example, suitable weave mesh screens can include, but are not limited to, a plain Dutch weave, a twilled Dutch weave, a reverse Dutch weave, combinations thereof, or the like. In other embodiments, however, the sand screen 208 can include a single layer of wire mesh, multiple layers of wire mesh that are not bonded together, a single layer of wire wrap, multiple layers of wire wrap or the like, that can or cannot operate with a drainage layer. Those skilled in the art will readily recognize that several other mesh designs are equally suitable, without departing from the scope of the disclosure. Moreover, in some embodiments, the sand screen 208 can be replaced with a slotted liner or other type of downhole filtration device.

As illustrated, the sand screen 208 can be radially offset a short distance from the base pipe 202 so that an annulus 214 is defined radially between the sand screen 208 and the base pipe 202. The annulus 214 forms part of a flow path for the fluids 210 to enter the interior 206 of the base pipe 202. More specifically, the flow path for the fluids 210 extends from the formation 110, through the sand screen 208, through the power generator outlets 204 defined in the base pipe 202, and into the interior 206 to be produced to the surface location via, for example, the production tubing 112 (FIG. 1). Accordingly, the flow path for the fluids 210 includes any portion of the aforementioned path or route.

The downhole assembly 200 can further include a flow control device 216 positioned within the flow path and configured to receive a flow of the fluid 210 prior to entering the base pipe 202. In some embodiments, as illustrated, the flow control device 216 can be positioned within a channel or conduit 218 defined in the upper end ring 212*a* or another sub (not shown) included in the downhole assembly 200.

The downhole assembly 200 can also include an electronics module 220 configured to monitor and operate the flow control device 216. Accordingly, the flow control device 216 can be communicably coupled (either wired or wirelessly) to the electronics module 220. In some embodiments, as illustrated, the electronics module 220 can be coupled to or secured within the upper end ring 212*a*. In other embodiments, however, the electronics module 220 can be included in the downhole assembly 200 at another location, without departing from the scope of the disclosure.

The electronics module 220 can include, for example, computer hardware and/or software used to operate the flow control device 216 (and other components of the downhole assembly 200, if needed). The computer hardware can include a processor 222 configured to execute one or more sequences of instructions, programming stances, or code stored on a non-transitory, computer-readable medium and can include, for example, a general purpose microprocessor, a microcontroller, a digital signal processor, or any like suitable device. In some embodiments, the electronics module 220 can further include a power source 224 that provides electrical power to the flow control device 216 (and other components of the downhole assembly 200, if needed) for operation. The power source 224 can comprise, but is not limited to, one or more batteries, a fuel cell, a nuclear-based generator, a flow induced vibration power harvester, or any combination thereof.

In one or more embodiments, the power source 224 can be omitted from the electronics module 220 and electrical power required to operate the flow control device 216 (and other components of the downhole assembly 200, if needed) can be obtained from a downhole power generator 226 included in the downhole assembly 200. In the illustrated embodiment, the downhole power generator 226 is positioned within the flow path downstream from the flow control device 216 and otherwise configured to receive a flow of the fluid 210. In at least one embodiment, the downhole power generator 226 can comprise a transverse flow turbine assembly and, as illustrated, can be positioned within a cavity 228 defined in the upper end ring 212*a*. Alternatively, the downhole power generator 226 can be arranged in the flow path outside of the upper end ring 212*a* or at any point along the flow path, without departing from the scope of the disclosure.

As will be described in more detail below, the downhole power generator 226 can include a transverse turbine and an associated power generator. The transverse turbine can include a plurality of rotor blades configured to receive the fluid 210 from the flow path and convert the kinetic energy of the fluid 210 into rotational energy that generates electrical power in the power generator. The generated electrical power can be transferred to the electronics module 220 for power conditioning and rectification, or can otherwise be provided directly to the flow control device 216 (and other components of the downhole assembly 200, if needed).

The downhole assembly 200 can further include a sensor module 230 and a bi-directional communications module 232, each being communicably coupled (either wired or wirelessly) to the electronics module 220 to enable transfer of data and/or control signals to/from the electronics module 220. In some embodiments, however, the sensor module 230 can be directly coupled to the communications module 232, without departing from the scope of the disclosure. The power source 224 can be used to power one or both of the sensor module 230 and the communications module 232, but the downhole power generator 26 can alternatively be used to provide the required electrical power. While depicted in FIG. 2 as being arranged separately at opposing axial ends of the downhole assembly 200, the sensor module 230 and the communications module 232 can alternatively be positioned adjacent one another or can form a single module or component.

The sensor module 230 can be configured to monitor or otherwise measure various wellbore parameters during operation of the downhole assembly 200 and thereby obtain measurement data. The sensor module 230 can also include one or more transmitters and receivers used to communicate with the electronics module 220 (or the communications module 232) to provide measurement data. In at least one embodiment, the sensor module 230 can be configured to monitor the physical and chemical properties of the fluids 210 derived from the subterranean formation 110. Accordingly, the sensor module 230 can include a variety of sensors including, but not limited to, a radioactive sensor (e.g., gamma, neutron, and proton), a sonic emitter and receiver, an electromagnetic resistivity sensor, a sonic or acoustic sensor, a self/spontaneous potential sensor, a nuclear magnetic resonance logging sensor, a temperature sensor, a pressure sensors, a pH sensor, a density sensor, a viscosity sensor, a chemical composition sensor (e.g., sensors capable of determining the chemical makeup of the fluids 210 and otherwise capable of comparing chemical compositions of different fluids), a flow rate sensor, and the like.

The communications module 232 can be communicably coupled (either wired or wirelessly) to the electronics module 220 to enable transfer of data or control signals to/from the electronics module 220. The communications module 232 can further be communicably coupled to a well surface location (either wired or wirelessly) to enable transfer of data or control signals to/from the surface location during operation. Consequently, the communications module 232 can include one or more transmitters and receivers, for example, to facilitate bi-directional communication with the surface location. As a result, a well operator at the well surface location can be apprised of the real-time operational conditions of the downhole assembly 200 and can be able to send command signals to the flow control device 216 to adjust and otherwise regulate the flow of the fluid 210 when desired.

In one example, the sensor module 230 can be configured to monitor an advancing waterfront in the formation 110 and obtain measurement data regarding the location and/or flow rate of the waterfront. The sensor module 230 can transmit the measurement data to the electronics module 220 for processing. In some embodiments, the electronics module 220 can convey the measurement data to the communications module 232 to be transmitted to a well operator at a well surface location for consideration. In response, the well operator can send one or more command signals to the electronics module 220 via the communications module 232 to instruct the flow control device 216 to adjust operation. In other embodiments, however, the electronics module 220 can receive the measurement data from the sensor module 230 and be programmed to autonomously regulate operation of the flow control device 216 to minimize production of undesired fluids 210. For instance, when the measurement data surpasses a measured predetermined threshold of operation, the electronics module 220 can be programmed to actuate the flow control device 216 and thereby limit the influx of undesired fluids 210. In yet other embodiments, the sensor module 230 can send the measurement data directly to the communications module 232 to be transmitted to the well operator for consideration. In such embodiments, if desired or warranted, the well operator can respond with a command signal to adjust operation of the flow control device 216.

Figure 3:
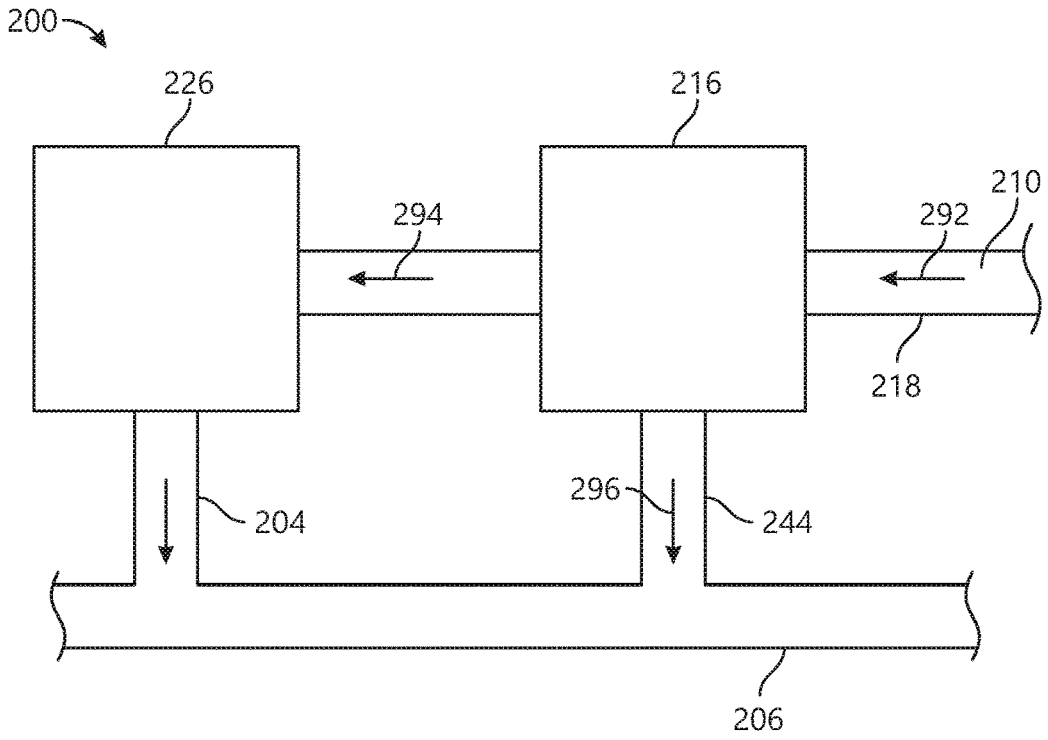
FIG. 3 illustrates a block diagram of an exemplary downhole assembly.

FIG. 3 illustrates a schematic block diagram of an exemplary downhole assembly 200. While some designs provide the flow control device 216 in series with the power generator 226, such designs require all fluid that is desired to arrive at the interior 206 of the base pipe to flow through the power generator 226. As such, the flow through the power generator 226 may be more than is needed to meet the power demands of the system. Furthermore, such designs do not allow any fluid to flow through the power generator 226 when the flow control device 216 is closed. As such, in such a configuration, no power can be generated to meet the power demands of the system.

As shown in FIG. 3, the downhole assembly 200 can provide multiple flow paths that allow the power generator 226 to receive a flow of fluid that is separate from another flow directly to the interior 206 of the base pipe. For example, the downhole assembly 200 can include the flow control device 216, which is positioned to receive the fluid 210 from the exterior of the base pipe. The flow control device 216 is configured to adjustably control an amount of the fluid 210 that passes to the interior 206 of the base pipe. The fluid 210 can be directed from the flow control device 216 through the power generator 226 and through a power generator outlet 204 to the interior 206 of the base pipe. The fluid 210 can also be directed via the flow control device outlet 244 to the interior 206 without passing through the power generator 226.

The flow control device 216 can controllably adjust amounts of flow to the power generator 226 and the interior 206. For example, the flow control device 216 can receive a first flow 292 of the fluid 210 from the exterior of the base pipe and adjustably control an amount that is directed to the power generator 226 as second flow 294 and an amount that is directed to the interior 206 of the base pipe 202 as third flow 296 without passing through the power generator 226. The flow control device 216 can be adjusted between different configurations that alter the fluid flow. For example, in a first configuration, the flow control device 216 prevents or limits the second flow 294 to the power generator 226 and facilitates the third flow 296 directed to the interior 206 of the base pipe via a flow control device outlet 244 without passing through the power generator 226. In a second configuration, the flow control device 216 facilitates the second flow 294 to both the power generator 226 and the third flow 296 to the interior 206 of the base pipe without passing through the power generator 226. In another configuration, the flow control device 216 prevents or limits the second flow 294 and the third flow 296. The separate flows can be adjusted independently or in concert. In this manner, the flow control device 216 can facilitate flow to the interior 206 of the base pipe while also providing a desired amount of flow to generate power.

Figure 4:
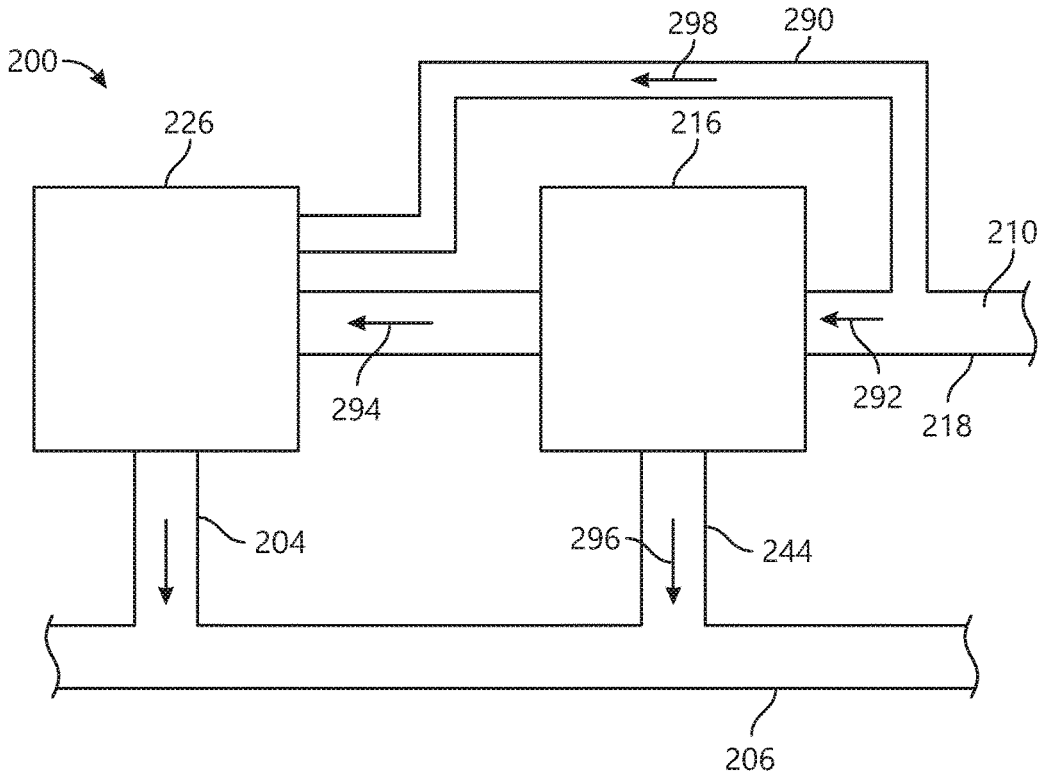
FIG. 4 illustrates a block diagram of another exemplary downhole assembly.

FIG. 4 illustrates a schematic block diagram of another exemplary downhole assembly 200. As shown in FIG. 4, the downhole assembly 20 can maintain a flow to the power generator 226 throughout all configurations and operations of the flow control device 216. A bypass line 290 can be provided to allow the fluid 210 to bypass the flow control device 216 and be directed to the power generator 226 without passing through the flow control device 216. For example, in addition to the second flow 294 and the third flow 296, which are controlled by the flow control device 216, the first flow 292 of the fluid 210 can produce a fourth flow 298 through the bypass line 290. The bypass line 290 can remain open in all configurations of the flow control device 216, so that a flow of the fluid 210 is provided to the power generator 226 regardless of the operation of the flow control device 216. This arrangement allows power to be generated throughout the various operations of the flow control device 216.

Figure 5:
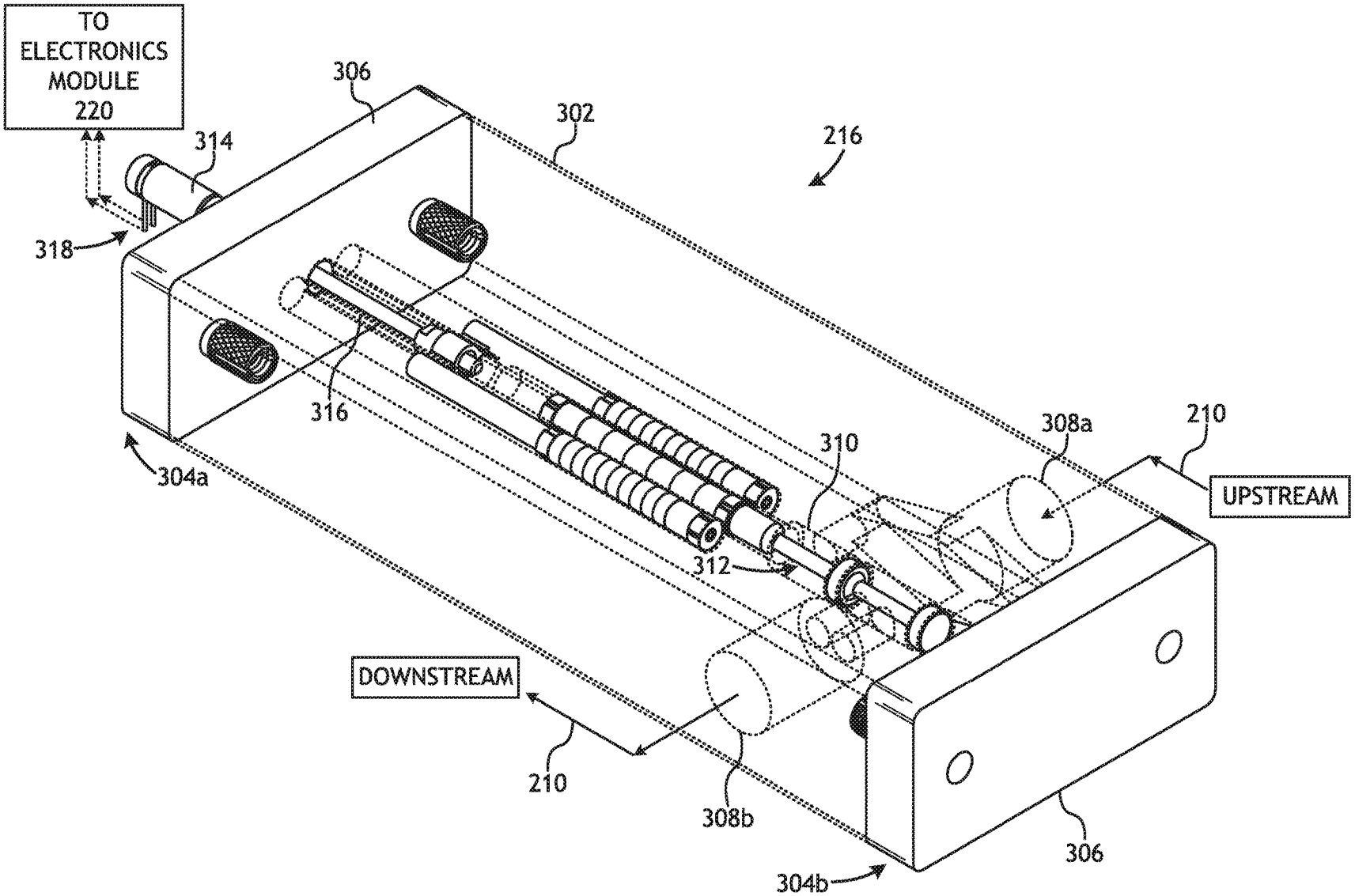
FIG. 5 illustrates an isometric view of an exemplary flow control device.

While the bypass line described above can be separate from the flow control device, the features of a bypass line can be integrated into the flow control device to allows flow there through in various configurations of the flow control device. FIG. 5 is an isometric view of an exemplary embodiment of the flow control device 216 that incorporates one or more openings, according to one or more embodiments. As illustrated, the flow control device 216 can include a housing 302 having a first end 304*a* and a second end 304*b* opposite the first end 304*a*. An end cap 306 can be coupled to the housing 302 at each end and removable to allow an operator to access the internal components of the flow control device 216. While depicted in FIG. 5 as generally rectangular in shape, the housing 302 can alternatively exhibit other shapes, such as any polygonal or cylindrical shape, without departing from the scope of the disclosure.

The housing 302 defines an inlet 308*a* that fluidly communicates with a piston chamber 310 defined within the housing 302. The inlet 308*a* can be configured to receive a flow of the fluid 210 upstream from the flow control device 216. The housing 302 also defines an outlet 308*b* that fluidly communicates with the piston chamber 310. Fluid 210 exiting the flow control device 216 via the outlet 308*b* can enter the conduit 218 downstream from the flow control device 216.

A pressure-balanced piston 312 is movably positioned within the piston chamber 310 and movable between a first or closed position, where the pressure-balanced piston 312 substantially prevents fluid flow through the piston chamber 310 between the inlet 308*a* and the outlet 308*b*, and a second or open position, where fluid flow around the pressure-balanced piston 312 and through the piston chamber 310 is facilitated. The pressure-balanced piston 312 can be moved between the closed and open positions with an actuator 314 at least partially positioned within an actuator chamber 316 defined within the housing 302. As described below, the actuator 314 can be operatively coupled to the pressure-balanced piston 312 such that axial movement of the actuator 314 within the actuator chamber 316 correspondingly moves the pressure-balanced piston 312 within the piston chamber 310. As used herein, the term "operatively coupled" refers to a direct or indirect coupled engagement between two component parts.

The actuator 314 can comprise a linear actuator such as, but not limited to, a mechanical actuator (e.g., a piston and solenoid, a screw-thread actuator, a wheel and axle actuator, a cam actuator, etc.), a hydraulic actuator, a pneumatic actuator, a piezoelectric actuator, an electro-mechanical actuator (e.g., a brush or brushless motor driving a gear box), a linear motor, a telescoping linear actuator, any combination thereof, or any low force (i.e., low power consumption) linear actuator. The actuator 314 can be communicably coupled to the electronics module 220 (FIG. 2) via one or more leads 318 (two shown) to facilitate power and signal transfer.

Figure 6:
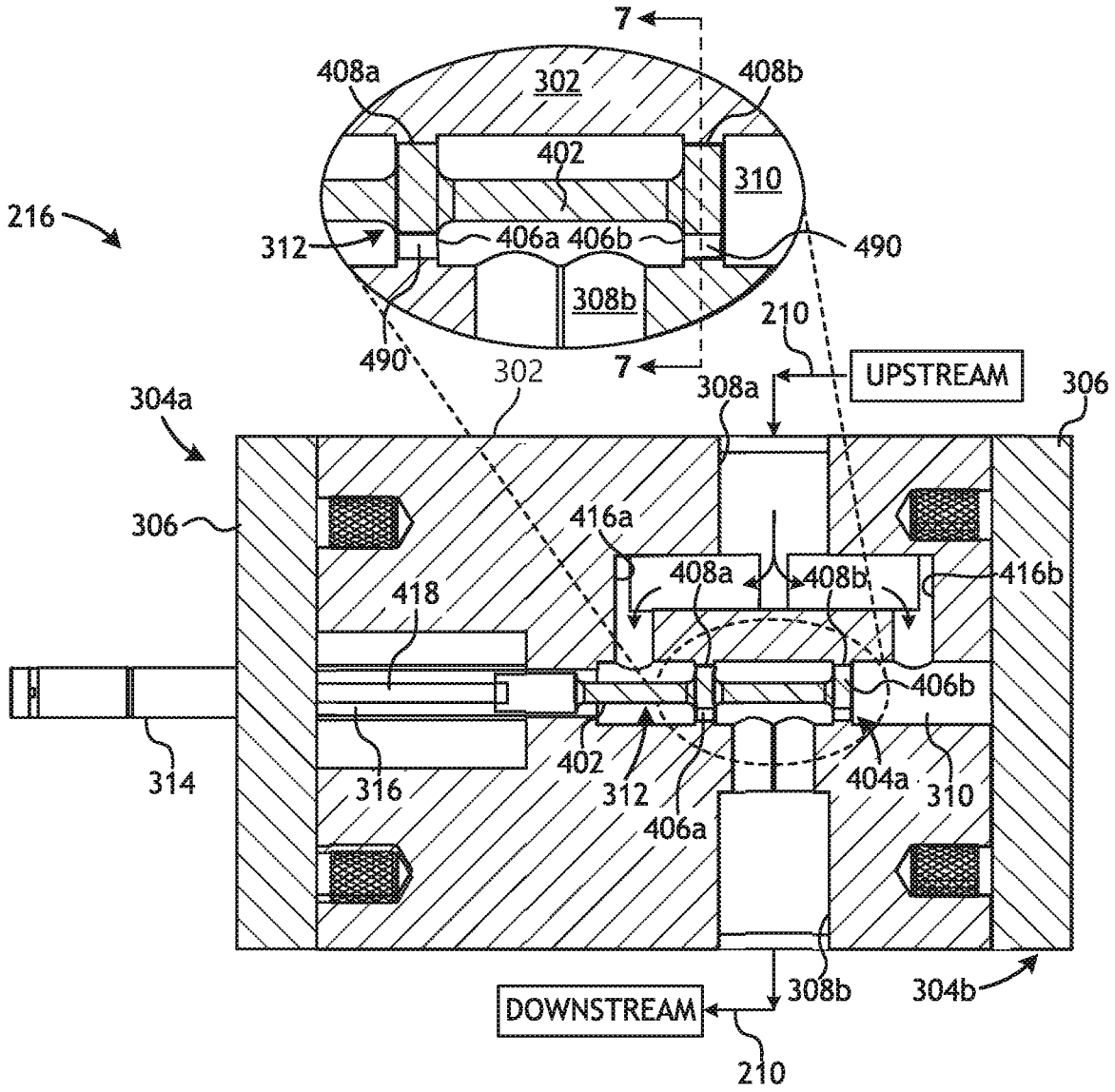
FIG. 6 illustrates a partial sectional top view of the flow control device of FIG. 5.

FIG. 6 illustrates a partial cross-sectional top view of the flow control device 216 of FIG. 5. As illustrated, the pressure-balanced piston 312 can include a piston rod 402 having a first end 404*a* and a second end 404*b* opposite the first end 404*a*. At or near the first end 404*a*, the pressure-balanced piston 312 can include a first piston head 406*a* axially spaced from a second piston head 406*b* and each coupled to the piston rod 402 or otherwise forming an integral part thereof.

The piston chamber 310 can define a first choke point 408*a* and a second choke point 408*b* axially spaced from the first choke point 408*a*. In the illustrated embodiment, the first choke point 408*a* and the second choke point 408*b* each provide a reduced diameter portion of the piston chamber 310 configured to radially engage the first piston head 406*a* and the second piston head 406*b* when the pressure-balanced piston 312 is in the closed position. Accordingly, the first piston head 406*a* and the second piston head 406*b* can be axially spaced from each other along the piston rod 402 to axially align with the first choke point 408*a* and the second choke point 408*b*.

As illustrated, the inlet 308*a* to the piston chamber 310 separates and otherwise splits into a first branch 416*a* and a second branch 416*b*. The first branch 416*a* communicates with the piston chamber 310 upstream from the first choke point 408*a* and the second branch 416*b* communicates with the piston chamber 310 upstream from the second choke point 408*b*. When the pressure-balanced piston 312 is in the closed position, as shown in FIG. 6, the fluid 210 entering the flow control device 216 via the inlet 308*a* separates into the first branch 416*a* and the second branch 416*b* and impinges on the upstream ends of the first piston head 406*a* and the second piston head 406*b*, respectively. The fluid 210 impinging on the upstream end of the first piston head 406*a* generates a pressure differential across the first piston head 406*a* and thereby urges the pressure-balanced piston 312 to the right in FIG. 6. The fluid impinging on the upstream end of the second piston head 406*b* generates a pressure differential across the second piston head 406*b* and thereby urges the pressure-balanced piston 312 to the left in FIG. 6. The hydraulic force acting on each of the first piston head 406*a* and the second piston head 406*b* can be substantially similar. Additionally, since the flow paths impinging on the first piston head 406*a* and the second piston head 406*b* are in opposite directions, the net hydraulic force acting upon the pressure-balanced piston 312 is zero. As a result, only a minimal axial force will be required to move the pressure-balanced piston 312 to the open position.

The first piston head 406*a* and the second piston head 406*b* can exhibit similar cross-sectional flow areas and can be sized to partially engage the first choke point 408*a* and the second choke point 408*b*, respectively, when the pressure-balanced piston 312 is in the closed position. The first piston head 406*a* and/or the second piston head 406*b* can provide an opening 490 to allow an amount of fluid to flow past the first choke point 408*a* and the second choke point 408*b*, respectively, even when the pressure-balanced piston 312 is in the closed position.

Figure 7:
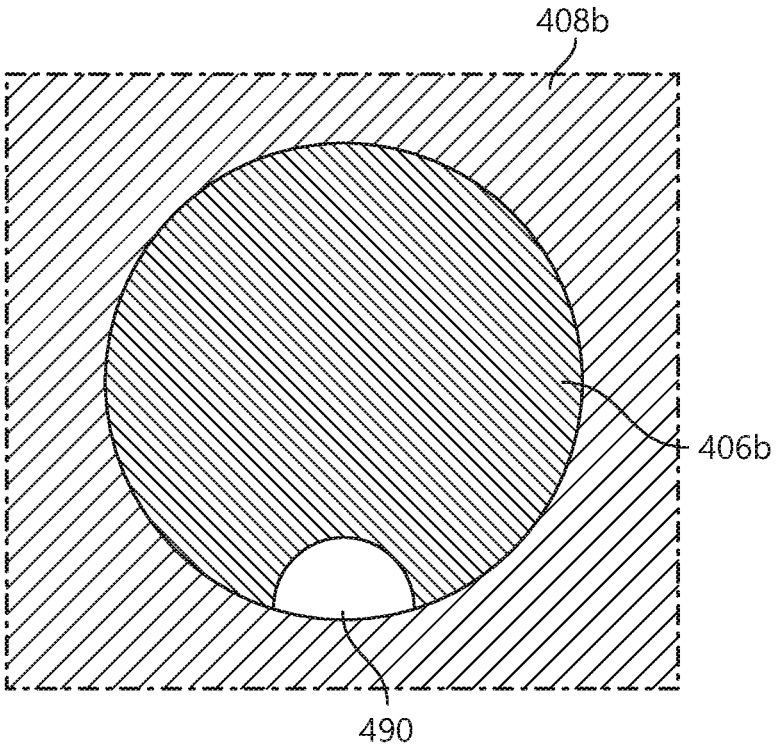
FIG. 7 illustrates a sectional view of an exemplary piston head of the flow control device of FIG. 6.

FIG. 7 illustrates a cross-sectional view of an exemplary piston head within a choke point. In the illustrated configuration, the second piston head 406*b* is partially engaged within the second piston head 406*b*. In this configuration, the second piston head 406*b* nonetheless provides an opening 490 extending there through to allow a flow of fluid to pass through the second piston head 406*b*, thereby providing fluid communication between the opposing sides of the second piston head 406*b*. The opening 490 can be formed at an outer periphery of the second piston head 406*b*, such that the opening 490 is partially formed by the second choke point 408*b*. Alternatively or in combination, the opening 490 can be within the second piston head 406*b*, such that the opening 490 is entirely defined by the second piston head 406*b*, rather than the second choke point 408*b*. The second piston head 406*b* can be provided with multiple openings 490. The size, shape, and number of openings 490 can be selected to provide a desired amount of flow there through. It will be appreciated that the features of the openings 490 can be applied to the first piston head 406*a*.

In some embodiments, one or both of the first piston head 406*a* and the second piston head 406*b* can exhibit a rectangular cross-sectional area. In such embodiments, the rectangular cross-sectional area could be elongated to provide additional fluid friction since a longer rectangular cross-section would allow for a larger gap between the first piston head 406*a* or the second piston head 406*b* and the corresponding first choke point 408*a* or second choke point 408*b*. In other embodiments, however, the first piston head 406*a* and the second piston head 406*b* can exhibit a cross-sectional area having a tapered surface 410 that is angled from the upstream to the downstream side of each of the first piston head 406*a* and the second piston head 406*b* and otherwise toward the outlet 308*b*. As a result, the first piston head 406*a* and the second piston head 406*b* can exhibit a larger diameter on the upstream side as compared to the downstream side. This can prove advantageous in helping clear sand and other debris that can circulate through the piston chamber 310 during operation. In some embodiments, the opening 490 forms a fluidic diode. In some embodiments, a portion of a gap between the first piston head 406*a* or the second piston head 406*b* and the corresponding first choke point 408*a* or second choke point 408*b* can be filled with a elastomeric or plastic seal, such as an O-ring or a plastic seal positioned on the outer diameter of one or both of the first piston head 406*a* and the second piston head 406*b* or on the inner diameter of one or both of the first choke point 408*a* and the second choke point 408*b*.

Figure 8:
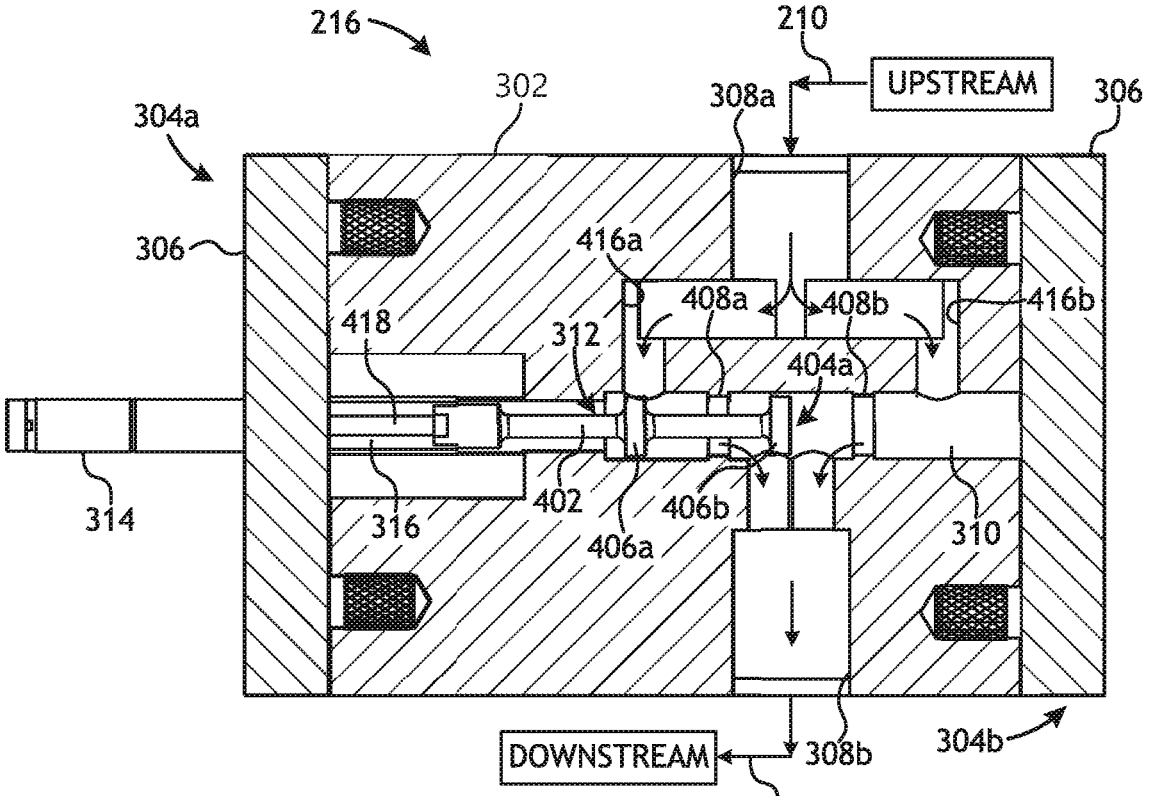
FIG. 8 illustrates another partial sectional top view of the flow control device of FIG. 5.

Exemplary operation of the flow control device 216 is now provided. While FIG. 6 shows the pressure-balanced piston 312 in the closed position, FIG. 8 shows the pressure-balanced piston 312 moved within the piston chamber 310 to the open position. Fluid 210 can enter the flow control device 216 from an upstream location at the inlet 308*a* and flow toward the piston chamber 310. The flow of the fluid 210 separates into the first branch 416*a* and the second branch 416*b* and flows toward the upstream ends of the first piston head 406*a* and the second piston head 406*b*, respectively. When the pressure-balanced piston 312 is in the closed position, as shown in FIG. 6, some of the fluid 210 passes through the openings 490. As such, limited flow is provided through the flow control device 216 to provide fluid communication between the exterior of the base pipe and the power generator while the first piston head 406*a* and the second piston head 406*b* are in any one of multiple positions. Additionally, some of the fluid 210 impinges on the respective upstream ends of the first piston head 406*a* and the second piston head 406*b* and a balanced hydraulic pressure differential is thereby generated across the first piston head 406*a* and the second piston head 406*b* in opposing axial directions within the piston chamber 310. As a result, there are no net hydraulic forces acting on the pressure-balanced piston 312.

The actuator 314 can then be actuated to move the pressure-balanced piston 312 toward the open position, as shown in FIG. 8. Upon actuating the actuator 314, the actuator rod 418 is drawn to the left in FIGS. 6 and 8. Moving the pressure-balanced piston 312 to the left moves the first piston head 406*a* and the second piston head 406*b* out of engagement with and otherwise away from the first choke point 408*a* and the second choke point 408*b*, which allows a greater amount of fluid 210 to flow past the first choke point 408*a* and the second choke point 408*b* and toward the outlet 308*b*. The forces on the pressure-balanced piston 312 can be balanced even when the pressure-balanced piston 312 is only partially closed/open. The fluid 210 exiting the flow control device 216 via the outlet 308*b* can enter the conduit 218 (FIG. 2) downstream from the flow control device 216, as shown in the downhole assembly 200 of FIG. 2.

Since the pressure-balanced piston 312 is hydraulically balanced via the first branch 416*a* and the second branch 416*b*, the axial force or load required to move the pressure-balanced piston 312 is greatly minimized. While operation of the flow control device 216 in FIGS. 6 and 8 shows the actuator 314 moving the actuator rod 418 to the left, this direction is by example only. In other embodiments, for instance, the actuator 314 can alternatively move the actuator rod 418 to the right in FIGS. 6 and 8 to move the pressure-balanced piston 312 from the closed position to the open position. Accordingly, as indicated above, use of directional terms such as left and right are merely used in relation to the illustrative embodiments as they are depicted in the figures. The use of directional terms "left" and "right" can alternatively by characterized as a "first direction" and a "second direction," where the first direction is opposite the second direction.

Figure 9:
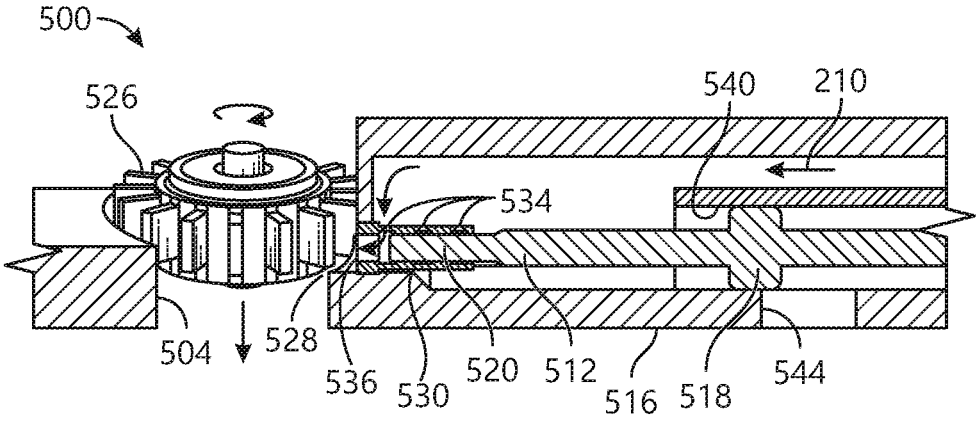
FIGS. 9, 10, and 11 illustrate partial sectional views of an exemplary flow control device.
Figure 10:
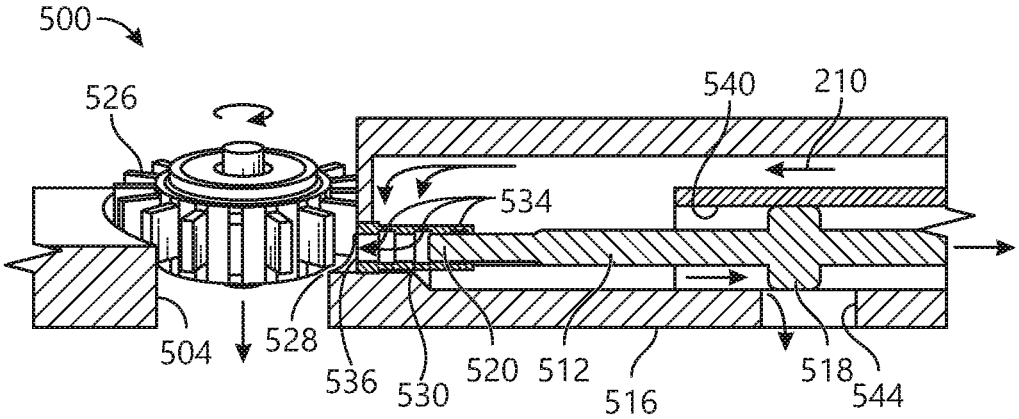
Figure 11:
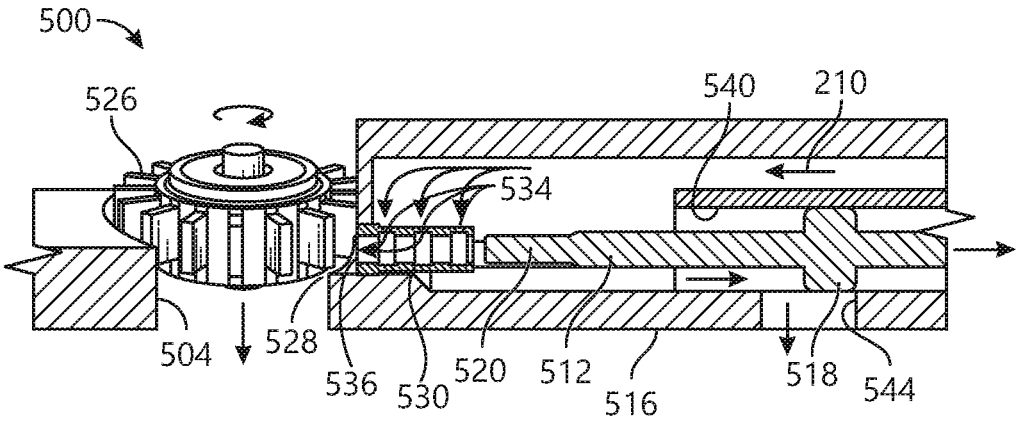

FIGS. 9-11 illustrate an exemplary downhole assembly that can be operated to provide consistent flow to a power generator. Illustrated components of the downhole assembly 500 can be incorporated into the well system 100 of FIG. 1, for example in place of one or more components of the downhole assembly 200 of FIG. 2.

As shown in FIG. 9, the downhole assembly 500 can include a flow control device 516 configured to receive a flow of the fluid 210 from the exterior of the base pipe. The flow control device 516 can direct incoming flow of the fluid 210 to the power generator 526 and through a power generator outlet 504 to the interior of the base pipe. The flow control device 516 can also direct incoming flow of the fluid 210 via a valve 540 and a flow control device outlet 544 to the interior without passing through the power generator.

The flow control device 516 can include or be connected to a nozzle 530 that can controllably direct at least some of the incoming flow of fluid 210 to the power generator 526. The nozzle 530 can include multiple flow ports 534 that can selectively provide fluid communication between the exterior of the base pipe and the power generator 526. The nozzle 530 can receive a first head 520 of a piston 512. The number of flow ports 534 not obstructed by the first head 520 collectively defines the flow area that is able to receive the incoming flow of fluid 210. The amount of flow received through the flow ports 534 is directed through a nozzle outlet 536 to the power generator 526.

The nozzle 530 can include any number of flow ports 534. At least one of the flow ports 534 can receive the first head 520 of a piston 512. The flow ports 534 can be distributed along a longitudinal axis of the nozzle 530. At least some of the flow ports 534 can be on a single radial side of the nozzle 530. Alternatively or in combination, at least some of the flow ports 534 can be on different and/or opposing radial sides of the nozzle 530. The flow ports 534 can be of the same or different sizes, so that a desired amount of flow is provided based on the number and/or size of the open flow ports.

The flow control device 516 can further include a valve 540 that can controllably direct at least some of the incoming flow of fluid 210 to the flow control device outlet 544. The valve 540 can include a space for receiving a second head 518 of the piston 512 and selectively providing fluid communication between the exterior of the base pipe and the interior of the base pipe via the flow control device outlet 544. The amount of flow received through the valve 540 bypasses the power generator 526.

The flow control device 516 can make simultaneous adjustments to flow paths through the power generator 526 and flow paths through the valve 540. For example, the piston 512 can be configured to move between multiple positions to simultaneously move the first head 520 within the nozzle 530 and the second head 518 within the valve 540. Movement of the first head 520 within the nozzle 530 can change the number of flow ports 534 that are open and the number of flow ports 534 that are closed, thereby controlling the flow area into the nozzle 530 that is able to receive the incoming flow of fluid 210. Movement of the second head 518 within the valve can change the flow area into the flow control device outlet 544 that is able to receive the incoming flow of fluid 210.

Exemplary operation of the flow control device 516 is now provided. FIG. 9 shows the piston 512 in a closed position, with the second head 518 fully obstructing flow of the fluid 210 through the valve 540 and to the flow control device outlet 544. In this position, the first head 520 is positioned so that one or more of the flow ports 534 of the nozzle 530 is unobstructed, so that flow is provided to the power generator 526 even when the valve 540 is closed. It will be appreciated that the piston 512 can be positioned so that all of the flow ports 534 are obstructed.

FIG. 10 shows the piston 512 in a partially open position, with the second head 518 partially obstructing flow of the fluid 210 through the valve 540 and to the flow control device outlet 544. In this position, the first head 520 is positioned so that a greater number of the flow ports 534 of the nozzle 530 are unobstructed. Because the valve 540 is partially open, the hydraulic energy on the nozzle 530 would be reduced. To compensate for this reduction, the increased number of open flow ports 534 provides increased flow, so that the amount of flow to the power generator 526 is substantially maintained. The diameter of the flow ports 534 can have varying diameters and varying flow restrictions along the length.

FIG. 11 shows the piston 512 in a fully open position, with the second head 518 not substantially obstructing flow of the fluid 210 through the valve 540 and to the flow control device outlet 544. In this position, the first head 520 can be positioned outside the nozzle 530 so that a maximum number of the flow ports 534 of the nozzle 530 are unobstructed. A flow port 534 that previously received the first head 520 can also be opened. Because the valve 540 is fully open, the hydraulic energy on the nozzle 530 would be further reduced. To compensate for this reduction, the maximum number of open flow ports 534 provides increased flow, so that the amount of flow to the power generator 526 is still substantially maintained. Accordingly, the flow to the power generator 526 is maintained at a substantially consistent level across multiple levels of flow through the valve 540. This provides consistent levels of power generated throughout operation of the flow control device 516. The adjustment of flow through the nozzle and to the power generator is made automatically upon adjustment of flow through the valve. Accordingly, the adjustment of flow is passive and self-regulating.

Figure 12:
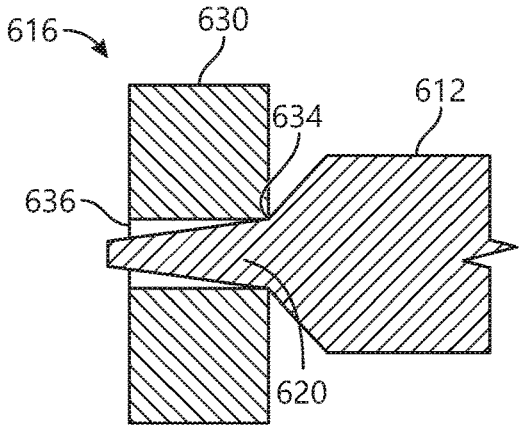
FIGS. 12, 13, and 14 illustrate sectional views of an exemplary piston and nozzle of a flow control device.
Figure 13:
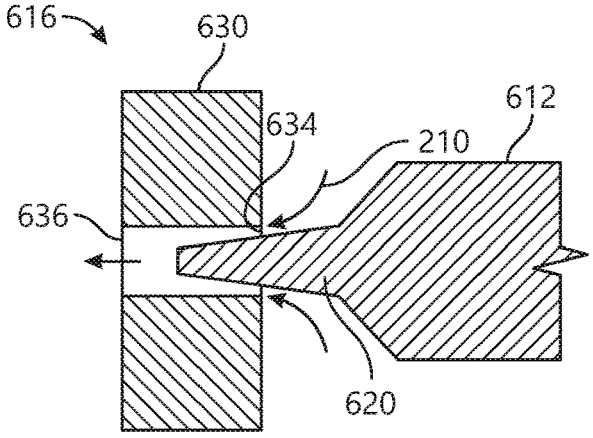
Figure 14:
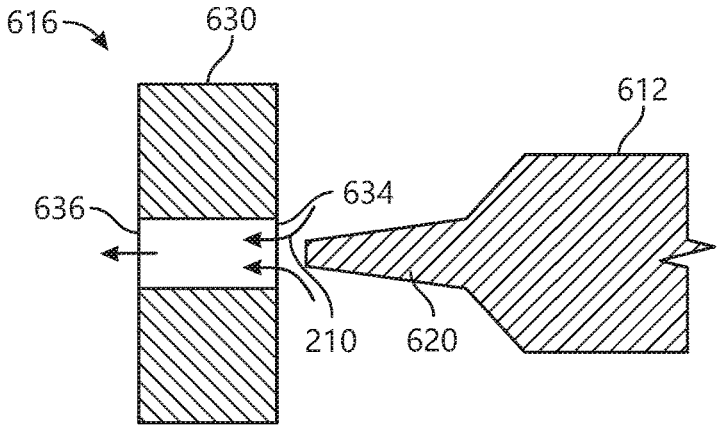

FIGS. 12-14 illustrate an exemplary flow control device 616 that can be operated to provide consistent flow to a power generator. Illustrated components of the flow control device 616 can be incorporated into the downhole assembly 500 of FIGS. 9-11. While the flow control device 516 of FIGS. 9-11 includes the nozzle 530 having multiple, discrete flow ports 534, the flow control device 616 can provide continuously variable adjustment of flow area to a power generator. As illustrated, the flow control device 616 can include to a nozzle 630 that can controllably direct at least some of the incoming flow of fluid 210 to the power generator. The nozzle 630 can include a nozzle inlet 634 and a nozzle outlet 636. The nozzle 630 can receive a head 620 of a piston 612. Movement of the head 620 within the nozzle 630 can change the flow area into the nozzle inlet 634.

The head 620 can have a size and shape that facilitates sealing with the nozzle 630 and/or a desired flow into the nozzle inlet 634. For example, the head 620 can be tapered with a variable cross-sectional dimension. Accordingly, positioning different portions of the head 620 at the nozzle inlet 634 defines different sizes for flow areas into the nozzle 630 to manage flow therein. The head 620 can have an outer shape that is complementary to an inner shape of the nozzle 630.

Exemplary operation of the flow control device 616 is now provided. FIG. 12 shows the piston 612 in a closed position, with the head 620 fully obstructing flow of the fluid 210 through the nozzle 630. This position of the piston 612 can correspond to the valve configuration illustrated in FIG. 9.

FIG. 13 shows the piston 612 in a partially open position, with the head 620 partially obstructing flow of the fluid 210 through the nozzle 630. In this position, the head 620 is positioned so that a greater flow area at the nozzle inlet 634 is provided. This position of the piston 612 can correspond to the valve configuration illustrated in FIG. 10. Because the valve of FIG. 10 is partially open, the hydraulic energy on the nozzle 630 would be reduced. To compensate for this reduction, the increased flow area provides increased flow, so that the amount of flow to the power generator is substantially maintained.

FIG. 14 shows the piston 612 in a fully open position, with the head 620 removed from the nozzle 630. In this position, the head 620 is positioned so that a maximum flow area at the nozzle inlet 634 is provided. This position of the piston 612 can correspond to the valve configuration illustrated in FIG. 11. Because the valve of FIG. 10 is fully open, the hydraulic energy on the nozzle 630 would be further reduced. To compensate for this reduction, the maximum flow area at the nozzle inlet 634 is provided, so that the amount of flow to the power generator is still substantially maintained. Accordingly, the flow to the power generator is maintained at a substantially consistent level across multiple levels of flow through the valve. This provides consistent levels of power generated throughout operation of the flow control device 616.

Figure 15:
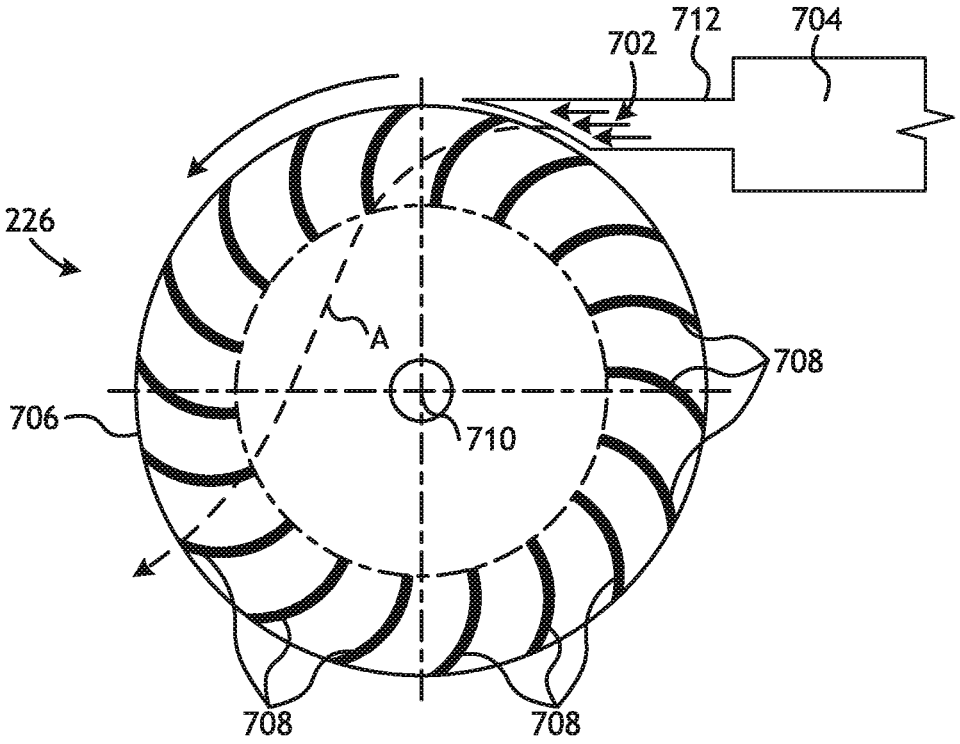
FIG. 15 illustrates a schematic diagram of an exemplary downhole power generator.

FIG. 15 illustrates a schematic diagram of an exemplary embodiment of the downhole power generator 226 of FIG. 2 or the downhole power generator 526 of FIGS. 9-11, according to one or more embodiments. The downhole power generator 226 can be characterized as a transverse flow turbine configured to receive a flow of a fluid 702 from a flow path 704 and convert the kinetic energy and potential energy of the fluid 702 into rotational energy that generates electrical power. The flow path 704 can be, for example, a portion of the conduit 218 shown in FIG. 2.

The downhole power generator 226 can include a transverse turbine 706 having a plurality of blades 708 disposed thereabout and configured to receive the fluid 702. As the fluid 702 impinges upon the blades 708, the transverse turbine 706 is urged to rotate about a rotational axis 710. Unlike conventional downhole power-generating turbines, which require axial fluid flow and otherwise fluid flow that is parallel to the rotational axis of the turbine, the fluid 702 in the downhole power generator 226 is perpendicular to the rotational axis 710 of the transverse turbine 706. As a result, more power is generated at a given flow rate as compared to axial flow turbine assemblies.

Before impinging upon the blades 708, the fluid 702 can pass through a nozzle 712 arranged within the flow path 704 upstream from the transverse turbine 706. The nozzle 712 increases the kinetic energy of the fluid 702, which results in an increased power output from the downhole power generator 226. The transverse turbine 706 receives the fluid 702 transversely (i.e., across) the blades 708, and the fluid 702 flows through the transverse turbine 706, as indicated by the dashed arrow A. As the fluid 702 flows through the transverse turbine 706, the blades 708 are urged to rotate the transverse turbine 706 about the rotational axis 710 and thereby generate electricity in an associated power generator (not shown). The transverse turbine 706 of FIG. 15 is depicted as a cross-flow turbine but could alternatively be any other type of turbine that receives a flow of fluid perpendicular to its rotational axis.

Figure 16:
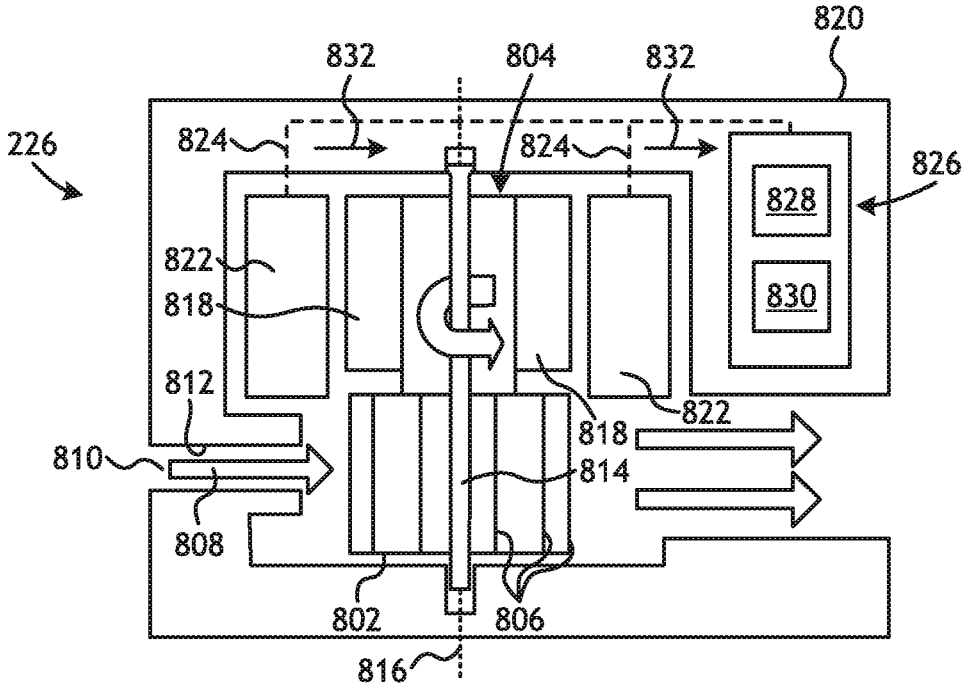
FIG. 16 illustrates a schematic diagram of another exemplary downhole power generator.

FIG. 16 depicts a schematic diagram of another exemplary embodiment of the downhole power generator 226 of FIG. 2 or the downhole power generator 526 of FIGS. 9-11, according to one or more embodiments. The downhole power generator 226 of FIG. 16 includes a transverse turbine 802 operatively coupled to a power generator 804. The transverse turbine 802 of FIG. 16 is depicted as a water wheel-type turbine and can include a plurality of blades 806 disposed thereabout and configured to receive a flow of a fluid 808 from a flow path 810 and convert the kinetic energy of the fluid 808 into rotational energy that generates electrical power. The flow path 810 can include a nozzle 812 that increases the kinetic energy of the fluid 808 before impinging upon the blades 806.

The transverse turbine 802 can be operatively coupled to a rotor 814 that rotates about a rotational axis 816. The rotor 814 can extend into the power generator 804 and can include a plurality of magnets 818 disposed thereon for rotation therewith. The generator 804 can further include a stator 820 and one or more magnetic pickups or coil windings 822 positioned on the stator 820. One or more electrical leads 824 can extend from the coil windings 822 to a power conditioning unit 826, such as the power conditioning unit included in the electronics module 220 of FIG. 2. As illustrated, the power conditioning unit can include a power storage device 828 and a rectifier circuit 830 that operate to store and deliver a steady power supply for use by a load, such as the flow control device 216 (FIG. 2), the sensor module 230 (FIG. 2), or the communications module 232 (FIG. 2).

In the illustrated embodiment, the power generator 804 is placed in the fluid 808 and otherwise is exposed to the fluid 808. The coil windings 822 and the leads 824 can be encapsulated or sealed with a magnetically-permeable material, such as a polymer, a metal, ceramic, an elastomer, or an epoxy, to protect the coil windings 822 and the leads 824 from potential fluid contamination, which could otherwise lead to corrosion or degradation of those components. As will be appreciated, placing the power generator 804 in the fluid 808 eliminates the need for a dynamic seal around the rotor 814, which could eventually wear out, or the need for magnetic couplers, which can introduce durability issues over extended operation of the power generator 804. In other embodiments, however, a dynamic seal could be employed, without departing from the scope of the disclosure.

In exemplary operation, the transverse turbine 802 receives the fluid 808 transversely (i.e., across) the blades 806, and the fluid 808 flows through the transverse turbine 802. As the fluid 808 impinges upon the blades 806, the transverse turbine 802 is urged to rotate about the rotational axis 816, thereby correspondingly rotating the magnets 818 as positioned on the rotor 814. The coil windings 822 convert the rotational motion of the rotor 814 into electric energy in the form of current 832. The current 322 then traverses the leads 824 extending to the power conditioning unit 826 for storage and rectification.

Figure 17:
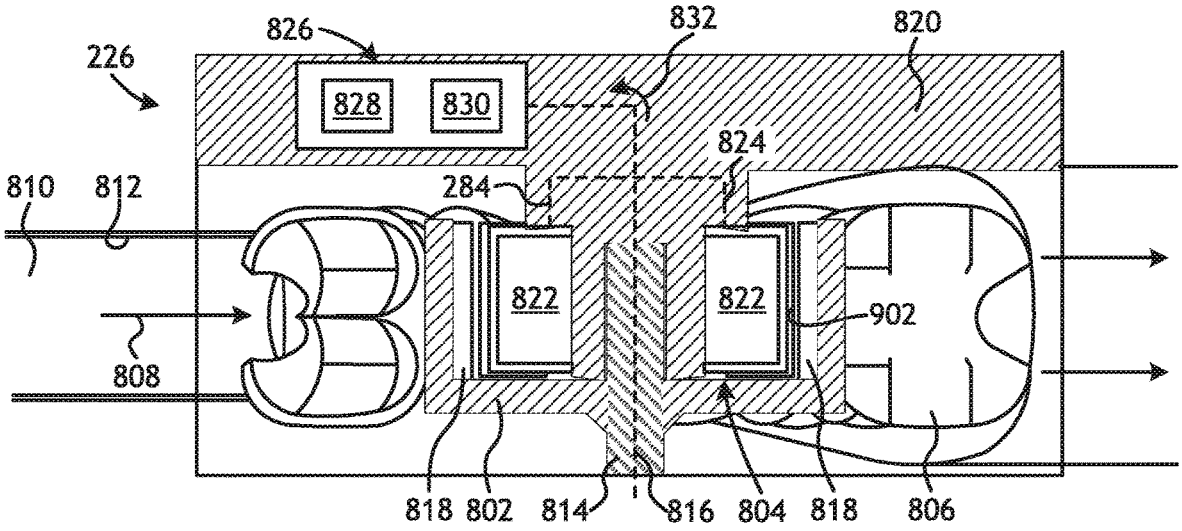
FIG. 17 illustrates a schematic diagram of another exemplary downhole power generator.

FIG. 17 depicts a schematic diagram of another exemplary embodiment of the downhole power generator 226 of FIG. 2 or the downhole power generator 526 of FIGS. 9-11, according to one or more embodiments. The downhole power generator 226 of FIG. 2 can be similar in some respects to the downhole power generator 226 of FIG. 16 and therefore will be best understood with reference thereto, where like numerals indicate like components or elements not described again. Similar to the downhole power generator 226 of FIG. 16, the downhole power generator 226 of FIG. 17 includes the transverse turbine 802, the power generator 804, and the blades 806 disposed about the transverse turbine 802 and to receive the fluid 808 from the flow path 810 and convert kinetic energy of the fluid 808 into rotational energy that generates electrical power. The nozzle 812 is positioned within the flow path 810 to increase the kinetic energy of the fluid 808 before impinging upon the blades 806.

Unlike the downhole power generator 226 of FIG. 16, however, the transverse turbine 802 of the downhole power generator 226 of FIG. 17 can be characterized as a Pelton wheel or a Turgo turbine, and the power generator 804 of the downhole power generator 226 of FIG. 17 can be generally positioned within the transverse turbine 802, which reduces the axial height of the transverse turbine assembly 400. More specifically, as illustrated, the transverse turbine 802 can be coupled to the rotor 814 to rotate about the rotational axis 816, and the plurality of magnets 818 can be disposed or otherwise positioned on the transverse turbine 802 for rotation therewith. The stator 820 can extend at least partially into a hub 902 defined by the transverse turbine 802 and the magnetic pickups or coil windings 822 can be positioned within the hub 902 to interact with the magnets 818. As will be appreciated, this embodiment allows the power generator 804 to have a very short axial length as compared to the power generator 804 of FIG. 16.

Operation of the downhole power generator 226 of FIG. 17 can be substantially similar to operation of the downhole power generator 226 of FIG. 16 and therefore will not be described again. Any type or configuration of turbine that is configured to receive fluid flow perpendicular to the rotational axis of the turbine can be suitable for use in any of the embodiments described herein. For instance, in other embodiments, a Francis or Jonval turbine can also be used, without departing from the scope of the disclosure. Additionally or alternatively, one or more axial turbines can be provided to receive fluid flow. By further example, a vibration based power generator, such as described in U.S. Pat. No. 7,199,480, can be provided. Any number of power generator (e.g., turbines) and valve systems can be provided to provided adequate power, including redundant systems to provide power in the event of insufficient power from any one of the systems.

Further Considerations

Various examples of aspects of the disclosure are described below as clauses for convenience. These are provided as examples, and do not limit the subject technology.

Clause A. A downhole assembly comprising: a base pipe defining an interior for receiving a fluid from an exterior of the base pipe, a power generator configured generate power with the fluid and direct the fluid to the interior of the base pipe, and a flow control device configured to receive a flow of the fluid from the exterior of the base pipe, the flow control device comprising: a nozzle, a valve, and a piston having a first head and a second head, the piston being moveable between multiple positions to simultaneously move the first head within the nozzle to adjust an amount of the flow directed to the power generator and to move the second head within the valve to adjust an amount of the flow directed to the interior of the base pipe without passing through the power generator.

Clause B. A downhole assembly comprising: a base pipe defining an interior for receiving a fluid from an exterior of the base pipe, a power generator configured generate power with the fluid and direct the fluid to the interior of the base pipe, a flow control device configured to receive a first flow of the fluid from the exterior of the base pipe and adjustably control an amount of the first flow directed to the power generator and an amount of the first flow directed to the interior of the base pipe without passing through the power generator, and a bypass line configured to receive a second flow of the fluid from the exterior of the base pipe and direct the second flow to the power generator without passing through the flow control device.

Clause C. A downhole assembly comprising: a base pipe defining an interior for receiving a fluid from an exterior of the base pipe, a power generator configured generate power with the fluid and direct the fluid to the interior of the base pipe, and a flow control device configured to receive a flow of the fluid from the exterior of the base pipe, the flow control device comprising: a piston head moveable between multiple positions within a piston chamber to control an amount of the flow directed to the power generator, and an opening extending through the piston head and providing fluid communication between the exterior of the base pipe and the power generator while the piston head is in any one of the multiple positions.

In one or more aspects, the method, drilling assembly, and/or non-transitory computer-readable tangible medium of any preceding paragraph, either alone or in combination, can further include one or more features of the additional clauses described below.

Element 1. Movement of the piston in a first direction increases the amount of the flow directed to the power generator and the amount of the flow directed to the interior of the base pipe without passing through the power generator.

Element 2. The nozzle provides multiple flow ports between the exterior of the base pipe and the power generator, and the first head of the piston is moveable to controllably obstruct one or more of the flow ports.

Element 3. The first head of the piston is moveable to adjust a flow area defined by a space between the first head and the nozzle.

Element 4. The piston is moveable between a first position and a second position, wherein: in the first position, the amount of the flow directed to the power generator is a first amount, and the amount of the flow directed to the interior of the base pipe without passing through the power generator is prevented, and in the second position, the amount of the flow directed to the power generator is a second amount, greater than the first amount, and the amount of the flow directed to the interior of the base pipe without passing through the power generator is facilitated.

Element 5. A sand screen between the flow control device and the exterior of the base pipe.

Element 6. An electronics module communicably coupled to the flow control device to operate the piston.

Element 7. A sensor module communicably coupled to the electronics module and including a sensor for obtaining measurement data corresponding to the fluid.

Element 8. A communications module communicably coupled to the electronics module and a well surface location to transfer data and/or control signals between the electronics module and the well surface location.

Element 9. The flow control device is adjustable between a first configuration and a second configuration, wherein: in the first configuration, the amount of the first flow directed from the flow control device and to the power generator is prevented, and the amount of the first flow directed to the interior of the base pipe without passing through the power generator is facilitated, and in the second configuration, the amount of the first flow directed from the flow control device and to the power generator is facilitated, and the amount of the first flow directed to the interior of the base pipe without passing through the power generator is facilitated.

Element 10. The piston head is a first piston head, the opening is a first opening, and the flow control device further comprises a pressure-balanced piston comprising: a piston rod, the first piston head and a second piston head coupled to the piston rod and axially spaced from each other, and a second opening extending through the second piston head and providing fluid communication between the exterior of the base pipe and the power generator.

Element 11. The flow control device further comprises: a first branch communicating with the piston chamber upstream from a first choke point provided in the piston chamber, and a second branch communicating with the piston chamber upstream from a second choke point provided in the piston chamber and axially offset from the first choke point, wherein the first piston head and the second piston head axially align with the first choke point and the second choke point, respectively, when the pressure-balanced piston is in a closed position.

Element 12. The piston head is adjustable between a first position and a second position, wherein: in the first position, the amount of the flow directed to the power generator is a first amount, and in the second position, the amount of the flow directed to the power generator is a second amount, greater than the first amount.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B. or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A downhole assembly comprising:

a base pipe defining an interior for receiving a fluid from an exterior of the base pipe;

a power generator configured generate power with the fluid and direct the fluid to the interior of the base pipe; and a flow control device configured to receive a flow of the fluid from the exterior of the base pipe, the flow control device comprising:

a nozzle;

a valve; and a piston having a first head and a second head, the piston being moveable between multiple positions to simultaneously move the first head within the nozzle to adjust an amount of the flow directed to the power generator and to move the second head within the valve to adjust an amount of the flow directed to the interior of the base pipe without passing through the power generator.

2. The downhole assembly of claim 1, wherein movement of the piston in a first direction increases the amount of the flow directed to the power generator and the amount of the flow directed to the interior of the base pipe without passing through the power generator.

3. The downhole assembly of claim 1, wherein the nozzle provides multiple flow ports between the exterior of the base pipe and the power generator, and the first head of the piston is moveable to controllably obstruct one or more of the flow ports.

4. The downhole assembly of claim 1, wherein the first head of the piston is moveable to adjust a flow area defined by a space between the first head and the nozzle.

5. The downhole assembly of claim 1, wherein the piston is moveable between a first position and a second position, wherein:

in the first position, the amount of the flow directed to the power generator is a first amount, and the amount of the flow directed to the interior of the base pipe without passing through the power generator is prevented; and in the second position, the amount of the flow directed to the power generator is a second amount, greater than the first amount, and the amount of the flow directed to the interior of the base pipe without passing through the power generator is facilitated.

6. The downhole assembly of claim 1, further comprising a sand screen between the flow control device and the exterior of the base pipe.

7. The downhole assembly of claim 1, further comprising an electronics module communicably coupled to the flow control device to operate the piston.

8. The downhole assembly of claim 7, further comprising a sensor module communicably coupled to the electronics module and including a sensor for obtaining measurement data corresponding to the fluid.

9. The downhole assembly of claim 7, further comprising a communications module communicably coupled to the electronics module and a well surface location to transfer data and/or control signals between the electronics module and the well surface location.

10. A downhole assembly comprising:

a base pipe defining an interior for receiving a fluid from an exterior of the base pipe;

a power generator configured generate power with the fluid and direct the fluid to the interior of the base pipe;

a flow control device configured to receive a first flow of the fluid from the exterior of the base pipe and adjustably control an amount of the first flow directed to the power generator and an amount of the first flow directed to the interior of the base pipe without passing through the power generator; and a bypass line configured to receive a second flow of the fluid from the exterior of the base pipe and direct the second flow to the power generator without passing through the flow control device.

11. The downhole assembly of claim 10, wherein the flow control device is adjustable between a first configuration and a second configuration, wherein:

in the first configuration, the amount of the first flow directed from the flow control device and to the power generator is prevented, and the amount of the first flow directed to the interior of the base pipe without passing through the power generator is facilitated; and in the second configuration, the amount of the first flow directed from the flow control device and to the power generator is facilitated, and the amount of the first flow directed to the interior of the base pipe without passing through the power generator is facilitated.

12. The downhole assembly of claim 10, further comprising a sand screen between the flow control device and the exterior of the base pipe.

13. A downhole assembly comprising:

a base pipe defining an interior for receiving a fluid from an exterior of the base pipe;

a power generator configured generate power with the fluid and direct the fluid to the interior of the base pipe; and a flow control device configured to receive a flow of the fluid from the exterior of the base pipe, the flow control device comprising:

a piston head moveable between multiple positions within a piston chamber to control an amount of the flow directed to the power generator; and an opening extending through the piston head and providing fluid communication between the exterior of the base pipe and the power generator while the piston head is in any one of the multiple positions.

14. The downhole assembly of claim 13, wherein the piston head is a first piston head, the opening is a first opening, and the flow control device further comprises a pressure-balanced piston comprising:

a piston rod;

the first piston head and a second piston head coupled to the piston rod and axially spaced from each other; and a second opening extending through the second piston head and providing fluid communication between the exterior of the base pipe and the power generator.

15. The downhole assembly of claim 14, wherein the flow control device further comprises:

a first branch communicating with the piston chamber upstream from a first choke point provided in the piston chamber; and a second branch communicating with the piston chamber upstream from a second choke point provided in the piston chamber and axially offset from the first choke point, wherein the first piston head and the second piston head axially align with the first choke point and the second choke point, respectively, when the pressure-balanced piston is in a closed position.

16. The downhole assembly of claim 13, wherein the piston head is adjustable between a first position and a second position, wherein:

in the first position, the amount of the flow directed to the power generator is a first amount; and in the second position, the amount of the flow directed to the power generator is a second amount, greater than the first amount.

17. The downhole assembly of claim 13, further comprising a sand screen between the flow control device and the exterior of the base pipe.

18. The downhole assembly of claim 13, further comprising an electronics module communicably coupled to the flow control device to operate the piston head.

19. The downhole assembly of claim 18, further comprising a sensor module communicably coupled to the electronics module and including a sensor for obtaining measurement data corresponding to the fluid.

20. The downhole assembly of claim 18, further comprising a communications module communicably coupled to the electronics module and a well surface location to transfer data and/or control signals between the electronics module and the well surface location.

* * * * *